US005722782A

United States Patent [19]

Rosenthal

[11] Patent Number: 5,722,782

[45] Date of Patent: Mar. 3, 1998

[54] WAX PENCIL HOLDING DEVICE

[76] Inventor: Donald M. Rosenthal, 3780 Elmira Ave., Claremont, Calif. 91711

[21] Appl. No.: 729,632

[22] Filed: Aug. 19, 1996

Related U.S. Application Data

[63] Continuation-in-part of Ser. No. 511,800, Aug. 7, 1995, Pat. No. 5,551,787.

[51] Int. Cl.[6] ..... B43K 21/08; B43K 21/06

[52] U.S. Cl. ..... 401/75; 401/173

[58] Field of Search ..... 401/75, 76, 173

[56] References Cited

U.S. PATENT DOCUMENTS

| | | | |
|---|---|---|---|
| 579,596 | 3/1897 | Mathiesen | 401/75 |
| 1,671,212 | 5/1928 | Spindler | 401/75 |
| 2,411,975 | 12/1946 | Nelson | 401/75 |

FOREIGN PATENT DOCUMENTS

| | | | |
|---|---|---|---|
| 240898 | 10/1990 | Japan | 401/75 |
| 612632 | 11/1948 | United Kingdom | 401/75 |

*Primary Examiner*—Steven A. Bratlie

[57] ABSTRACT

A wax pencil holding device including an intermediate hollow cylinder with an inner surface being threaded. Further provided is a top cap having an aperture centrally formed therein. An interior writing utensil holder tube is coaxially situated within the intermediate cylinder such that a top end of the tube communicates with the aperture of the top cap. The tube has at least one slit longitudinally formed therein, whereby a writing utensil may be situated within the tube and extended from the aperture of the top cap. Also included is a chuck situated within the tube. The chuck is adapted to slide vertically therein. As such, the writing utensil abuts the chuck when situated within the holder tube. Finally, an actuator disk is situated within the intermediate cylinder having a top face, a bottom face, and a threaded outer periphery for threadedly engaging the threaded inner surface of the intermediate cylinder. The actuator disk is coupled to the chuck through the slits of the holder tube, thereby effecting rotation of the actuator disk and dispensing of the writing utensil upon the rotation of the intermediate cylinder.

1 Claim, 5 Drawing Sheets

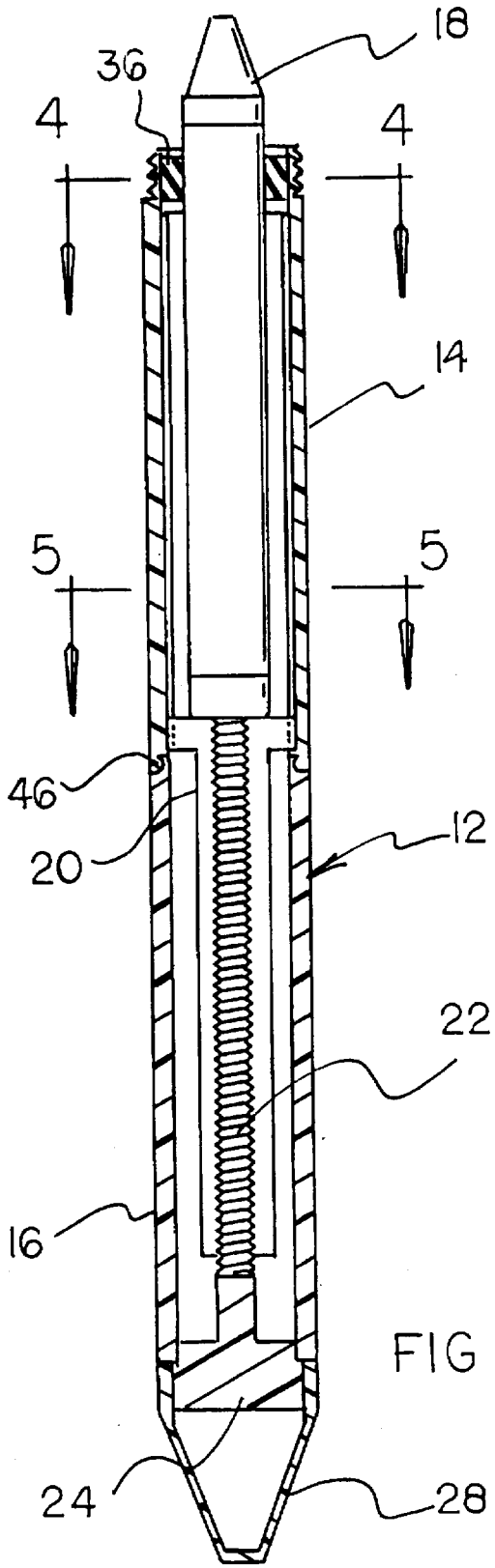
FIG 3
FIG 4
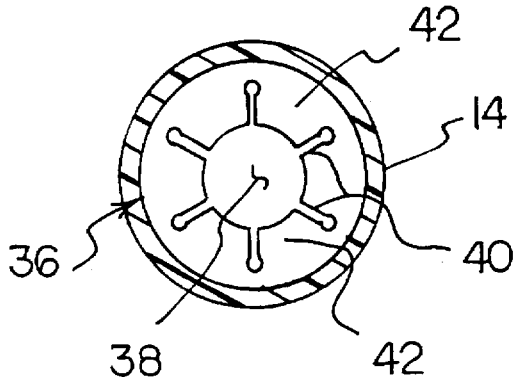
FIG 5
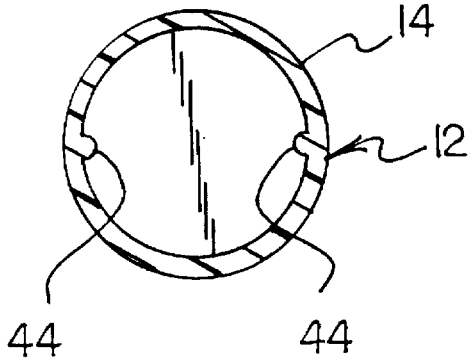

FIG 9
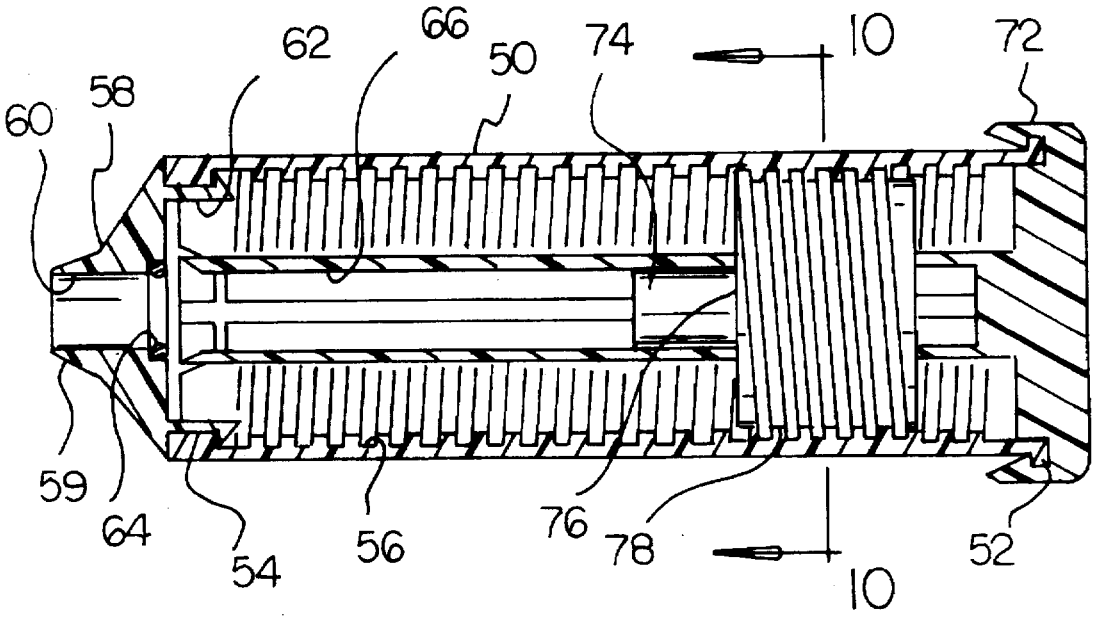
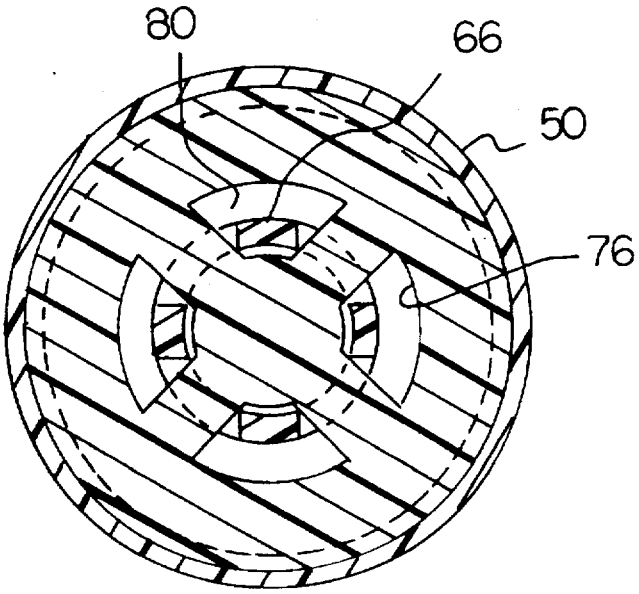
FIG 10

WAX PENCIL HOLDING DEVICE

Background Information

The present application is a continuation-in-part of an application filed Aug. 7, 1995 under Ser. No. 08/511,800 now U.S. Pat. No. 5,551,787.

BACKGROUND OF THE INVENTION

1. Field of the Invention

The present invention relates to writing instrument structures and more particularly pertains to a compact wax pencil holding device for safely supporting a wax pencil for writing.

2. Description of the Prior Art

The use of writing instrument structures is known in the prior art. More specifically, writing instrument structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art writing instrument structures include U.S. Pat. Nos. 4,468,146; 5,048,989; 4,991,299; 5,076,444; U.S. Pat. No. Design 290,854; and U.S. Pat. No. Design 332,281.

In this respect, the wax pencil holding device according to the present invention substantially departs from the conventional concepts and designs of the prior art, and in so doing provides an apparatus primarily developed for the purpose of providing a safe method of dispensing a writing utensil.

Therefore, it can be appreciated that there exists a continuing need for a new and improved wax pencil holding device which can be used for providing a safe method of dispensing a writing utensil. In this regard, the present invention substantially fulfills this need.

SUMMARY OF THE INVENTION

In view of the foregoing disadvantages inherent in the known types of writing instrument structures now present in the prior art, the present invention provides an improved wax pencil holding device. As such, the general purpose of the present invention, which will be described subsequently in greater detail, is to provide a new and improved wax pencil holding device which has all the advantages of the prior art and none of the disadvantages.

To attain this, the present invention essentially comprises an intermediate hollow cylinder is provided with an open bottom end, an open top end, and a closed periphery formed therebetween. Formed on the bottom end of the intermediate cylinder is a lower annular lip which extends outwardly therefrom. Further provided is an upper annular lip formed adjacent the top end of the and further extended inwardly therefrom. In addition, an inner surface of the entire closed periphery of the intermediate cylinder is threaded. As shown in FIG. 7, the present embodiment includes a top cap with a generally frusto-conical configuration. An aperture is centrally formed in the top cap. For releasably engaging the upper lip of the intermediate cylinder, a hooked tab mechanism depends from a lower surface of the top cap. As such, the top cap is allowed to be rotated with respect to the intermediate cylinder. The top cap further includes a bushing situated about an inner periphery of the aperture thereof and extended slightly inwardly. Situated coaxially within the intermediate cylinder is an interior writing utensil holder tube. The holder tube is maintained in its proper orientation via an integral coupling with the bottom surface of the top cap. By this structure, a top end of the tube communicates with the aperture of the top cap and the tube rotates coincidentally with the rotation of the top cap. The tube further has a plurality of slits longitudinally formed therein along an entire length thereof. In use, a writing utensil may be situated within the tube and extended from the aperture of the top cap. Also included is a bottom cap formed of a disk having a clamp mechanism extending upwardly therefrom. The clamp mechanism is adapted to allow the bottom cap to releasably engage the lower lip of the intermediate cylinder thus precluding access therein. As shown in FIG. 9, a chuck is included with a cylindrical configuration. The chuck is situated within the tube and, as such, is adapted to slide vertically therein. During the utilization of the present embodiment, the writing utensil abuts the chuck when situated within the holder tube. Finally, an actuator disk is situated within the intermediate cylinder having a top face, a bottom face, and a threaded outer periphery. The threaded outer periphery is adapted for threadedly engaging the threaded inner surface of the intermediate cylinder. It should be noted that the actuator disk has an aperture centrally formed therein for encompassing the holder tube. The actuator disk further has a plurality of inwardly extending connectors. Such connectors are integrally coupled between an inner periphery of the aperture of the disk and the chuck. To allow such, the connectors extend through the slits of the holder tube. By this structure, rotation of the actuator disk and dispensing of the writing utensil is effected upon the rotation of the top cap and holder tube.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wax pencil holding device which has all the advantages of the prior art writing instrument structures and none of the disadvantages.

It is another object of the present invention to provide a new and improved wax pencil holding device which may be easily and efficiently manufactured and marketed.

It is a further object of the present invention to provide a new and improved wax pencil holding device which is of a durable and reliable construction.

An even further object of the present invention is to provide a new and improved wax pencil holding device which is susceptible of a low cost of manufacture with regard to both materials and labor, and which accordingly is then susceptible of low prices of sale to the consuming public, thereby making such wax pencil holding device economically available to the buying public.

Still yet another object of the present invention is to provide a new and improved wax pencil holding device which provides in the apparatuses and methods of the prior art some of the advantages thereof, while simultaneously overcoming some of the disadvantages normally associated therewith.

Still another object of the present invention is to provide an apparatus for dispensing a writing utensil that is safe for children.

Yet another object of the present invention is to provide an apparatus for dispensing a writing utensil that is compact.

Lastly, it is an object of the present invention to provide a new and improved wax pencil holding device including an intermediate hollow cylinder with an inner surface being threaded. Further provided is a top cap having an aperture centrally formed therein. An interior writing utensil holder tube is coaxially situated within the intermediate cylinder such that a top end of the tube communicates with the aperture of the top cap. The tube has at least one slit longitudinally formed therein, whereby a writing utensil may be situated within the tube and extended from the aperture of the top cap. Also included is a chuck situated within the tube. The chuck is adapted to slide vertically therein. As such, the writing utensil abuts the chuck when situated within the holder tube. Finally, an actuator disk is situated within the intermediate cylinder having a top face, a bottom face, and a threaded outer periphery for threadedly engaging the threaded inner surface of the intermediate cylinder. The actuator disk is coupled to the chuck through the slits of the holder tube, thereby effecting rotation of the actuator disk and dispensing of the writing utensil upon the rotation of the intermediate cylinder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is a cross sectional view taken along line 4—4 of FIG. 3.

FIG. 5 is a cross sectional view taken along line 5—5 of FIG. 3.

FIG. 9 is a cross-sectional view taken along line 9—9 shown in FIG. 8.

FIG. 10 is a cross-sectional view taken along line 10—10 shown in FIG. 9.

Similar reference characters refer to similar parts throughout the several views of the drawings.

DESCRIPTION OF THE PREFERRED EMBODIMENT

Figure 1:
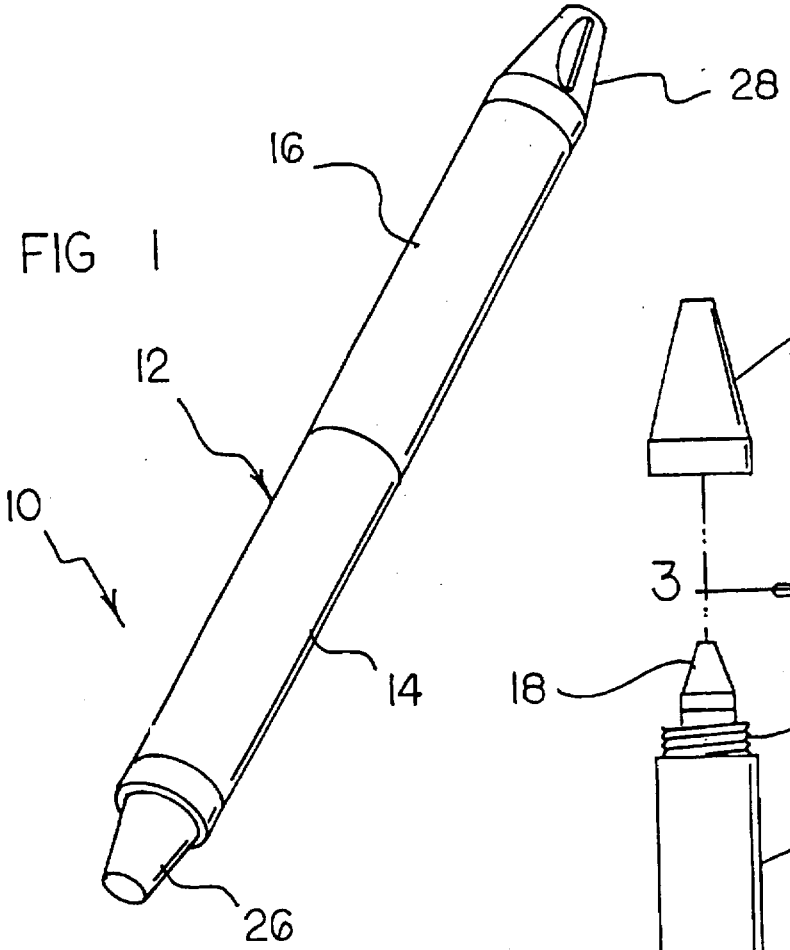
FIG. 1 is an isometric illustration of a wax pencil holding device according to the present invention.

With reference now to the drawings, and in particular to FIGS. 1–6 thereof, a new wax pencil holding device embodying the principles and concepts of the present invention and generally designated by the reference numeral 10 will be described.

More specifically, it will be noted that the wax pencil holding device 10 comprises an elongated main body 12 including a first portion 14 removably coupled to a second portion 16 substantially as shown in FIG. 1 of the drawings. A wax pencil 18 can be removably received within the first portion 14 of the main body 12. As shown in FIG. 3, a plunger 20 is slidably mounted within the main body 12 and abuttingly engages an interior end of the wax pencil 18 when positioned within the main body as shown in the drawings. A threaded rod 22 is threadably engaged to the plunger 20 and extends therefrom towards an end of the main body 12 whereat a knob 24 is rotatably mounted. The knob 24 is coupled to the threaded rod 22 such that a rotation of the knob will effect concurrent rotation of the threaded rod relative to the plunger 20 so as to effect axial movement of the plunger within the main body 12. By this structure, a wax pencil 18 can be inserted into the main body 12 and adjustably supported relative thereto through a manual axial positioning of the plunger 20 within the main body 12 accomplished through a rotation of the knob 24 so as to cause a desired amount of the wax pencil 18 to project from the main body 12 for use in a writing procedure.

Figure 2:
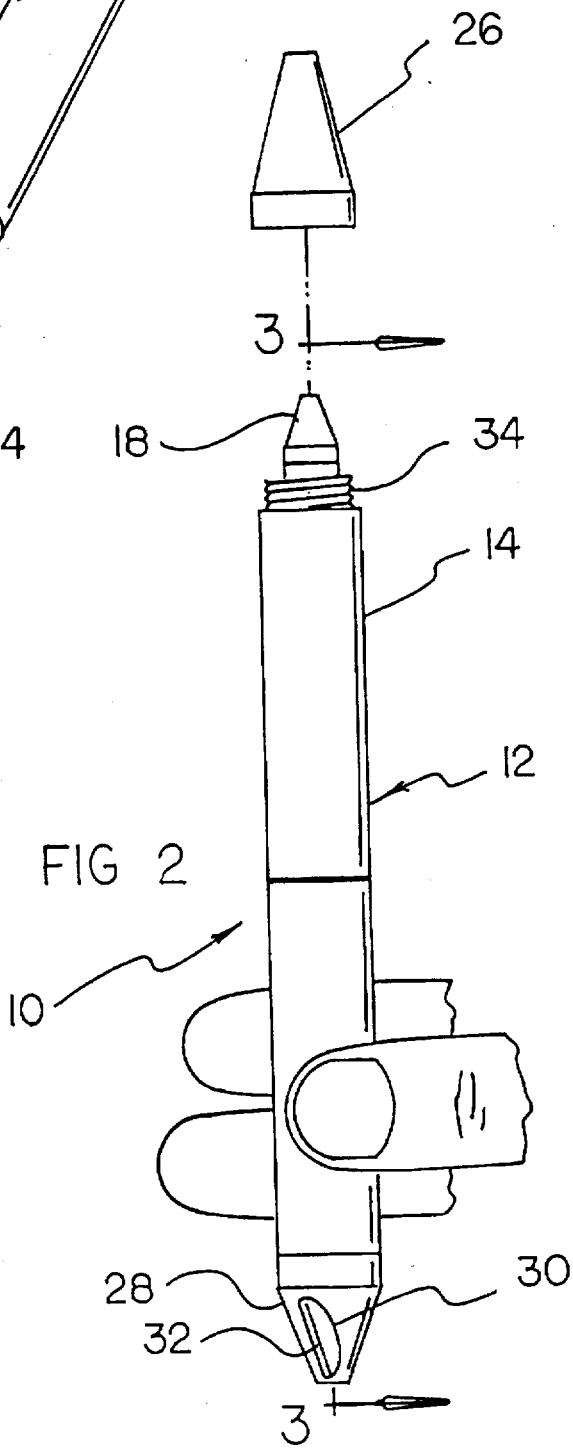
FIG. 2 is an exploded elevation view of the invention.

As best illustrated in FIGS. 1 and 2, it call be shown that the present invention 10 may further comprise a cover cap 26 removably coupled to the first portion 14 of the main body 12 so as to enclose the wax pencil 18 therewithin. Further, a sharpener cap 28 can be removably frictionally coupled to the knob 24 mounted to the second portion 16 of the main body 12. The sharpener cap 28 is operable to be selectively decoupled from the knob 20 and engaged to a writing end of the wax pencil 18 to effect sharpening thereof. To this end, the sharpener cap 28 is shaped so as to define an aperture 30 extending therethrough with a cutting blade 32 being mounted along an interior surface of the sharpener cap 28 so as to effect cutting of the wax pencil 18 with severed portions thereof being ejected from the sharpener cap 28 through the aperture 30 thereof. To removably couple to cover cap 26 to the first portion 14 of the main body 12, the first portion 14 of the main body desirably includes a threaded neck 34 projecting therefrom which threadably engages an interior portion of the cover cap 26.

Figure 6:
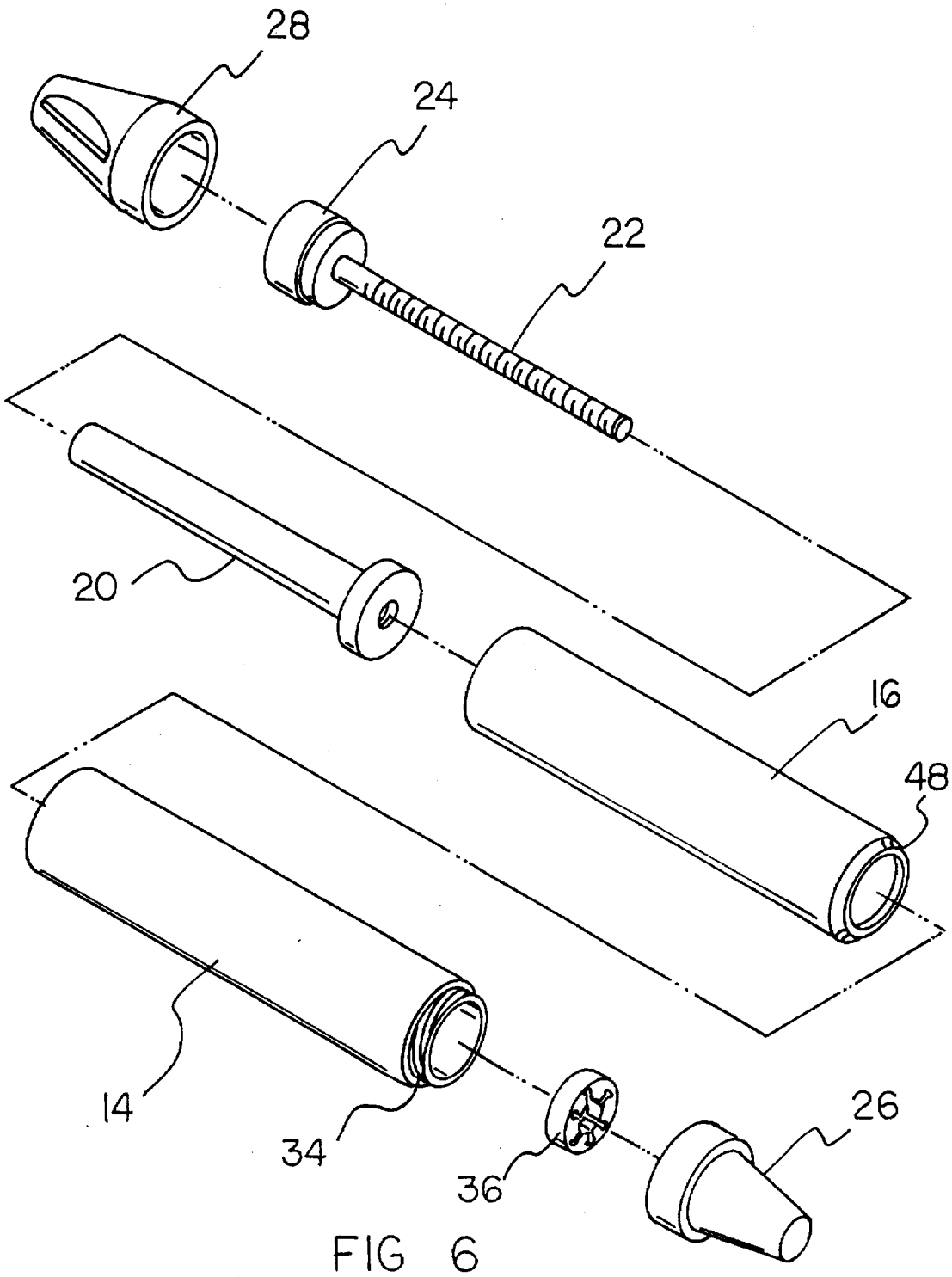
FIG. 6 is an exploded isometric illustration of the present invention.

Referring now to FIGS. 4 through 6, it can be shown that the present invention 10 further comprises a concentric support member 36 removably positioned within the first portion 14 of the main body 12 so as to permit the accommodation of a slender or thin wax pencil 18 therewithin. In other words, a relatively large or thick wax pencil 18 can be positioned within the first portion 14, with a relatively thin or small wax pencil 18 also being positioned within the first portion 14 in conjunction with the concentric support member 36, whereby the concentric support member operates to radially support the thin wax pencil 18 concentrically within the first portion 14 of the main body 12. To this end, and as specifically shown in FIG. 4, the concentric support member 36 is shaped so as to define a center aperture 38 directed therethrough which receives the wax pencil 18 therethrough. Further, the concentric support member 36 is shaped so as to define a plurality of radial apertures 40 extending from contiguous communication with the center aperture 38 and radially outwardly therefrom. The radial apertures 40 thus cooperate to define a plurality of resilient projections 42 which are cantilevered from an outer peripheral portion of the concentric support member 36 and resiliently engage an exterior surface of the wax pencil 18 when positioned through the center aperture 38 of the concentric support member 36. By this structure, the concentric support member 36 can support thin wax pencils 18 of varying outer diameters. In other words, the resilient projections 42 can resiliently deform so as to accommodate for variations in a thickness or diameter of a particular wax pencil 18 inserted through the center aperture 38 of the concentric support member 36.

With continuing reference to FIGS. 5 and 6, it can be shown that the plunger 20 is movably supported within the first portion 14 of the main body 12 and precluded from rotation relative thereto by a plurality of longitudinal projections 44 extending along diametrically opposed interior surfaces of the first portion 14 of the main body 12. The longitudinal projections 44 thus engage corresponding longitudinal grooves within the plunger 20 so as to slidably yet non-rotatably mount the plunger 20 within the main body 12. By this structure, a rotation of the knob 24 will effect concurrent rotation of the threaded rod 22 relative to the main body 12 and the plunger 20 non-rotatably affixed thereto so as to cause an axially advancement of the plunger 20 within the main body 12.

Referring to FIG. 3 with concurrent reference to FIG. 6, it can be shown that the second portion 16 of the main body 12 is removably coupled to the first portion 14. To this end, the first portion 14 is shaped so as to define an annular projection 46 extending radially inwardly therefrom which cooperatively engages an annular groove 48 extending into the second portion 16 of the main body 12. By this structure, the second portion 16 is easily snap-fitted into the first portion 14 so as to removably couple the portions of the main body 12 together.

As shown in FIG. 6, the present invention 10 may be easily de-constructed for cleaning and/or servicing of the components thereof.

In use, the wax pencil holding device 10 of the present invention can be easily utilized for supporting a wax pencil during a writing procedure. The cover cap 26 substantially protects a writing end of the wax pencil 18 during periods of non-use thereof, with the sharpener cap 28 being selectively useable by an individual as described above to effect restoration or sharpening of the writing end of the wax pencil when desired.

In an alternate embodiment, as shown in FIGS. 7–10, an intermediate hollow cylinder 50 is provided with an open bottom end, an open top end, and a closed periphery formed therebetween. Formed on the bottom end of the intermediate cylinder is a lower annular lip 52 which extends outwardly therefrom. Further provided is an upper annular lip 54 formed adjacent the top end of the hollow cylinder and further extended inwardly therefrom. In addition, an inner surface 56 of the entire closed periphery of the intermediate cylinder is threaded.

Figure 7:
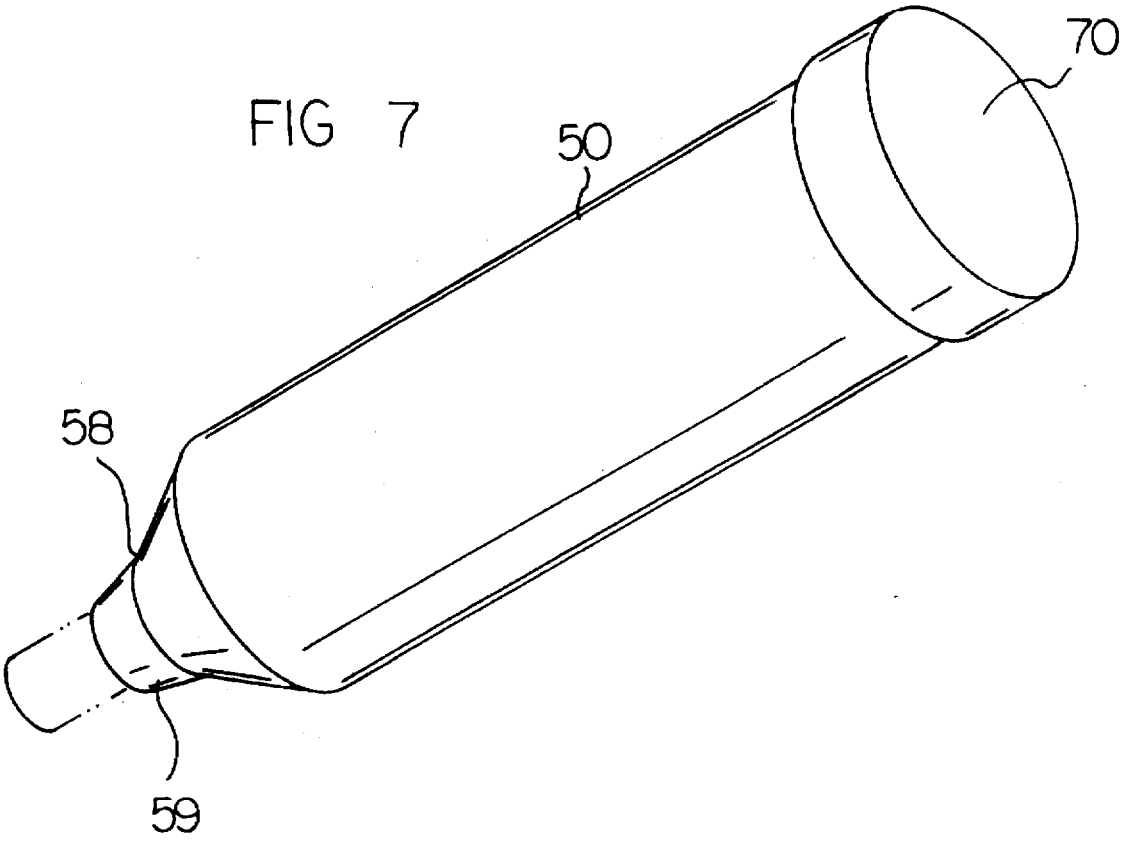
FIG. 7 is a perspective view of an alternate embodiment of the present invention.
Figure 8:
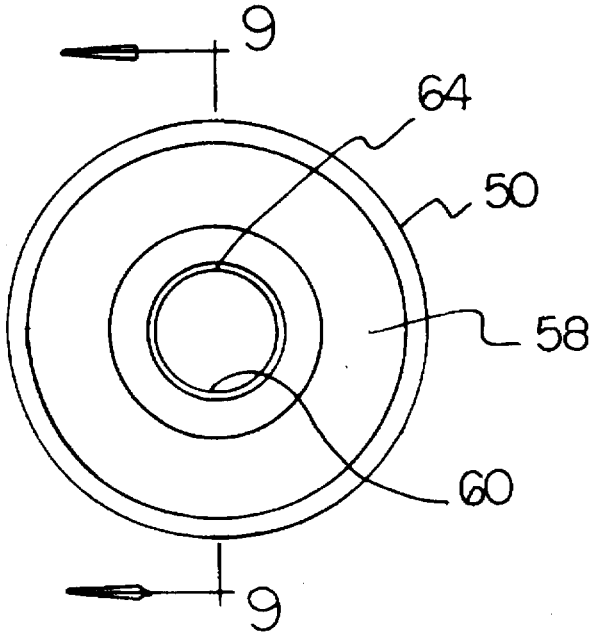
FIG. 8 is a front view of the alternate embodiment of the present invention.

As shown in FIG. 7, the present embodiment includes a top cap 58 with a generally frusto-conical configuration. Ideally, the top cap has an upper portion that is bevelled more than a lower portion thereof thereby defining a conveniently gripped knob 59. An aperture 60 is centrally formed in the top cap. For releasably engaging the upper lip of the intermediate cylinder, a hooked tab mechanism 62 depends from a lower surface of the top cap. As such, the top cap is allowed to be rotated with respect to the intermediate cylinder. The top cap further includes an elastomeric bushing 64 situated about an inner periphery of the aperture thereof and extended slightly inwardly. Preferably, an outer perimeter of the top cap sits flush with a periphery of the top end of the intermediate cylinder.

Situated coaxially within the intermediate cylinder is an interior writing utensil holder tube 66. The holder tube is maintained in its proper orientation via an integral coupling with the bottom surface of the top cap. By this structure, a top end of the tube communicates with the aperture of the top cap and the tube rotates coincidentally with the rotation of the top cap. The tube further has a plurality of slits longitudinally formed therein along an entire length thereof. In use, a writing utensil may be situated within the tube and extended from the aperture of the top cap.

Also included is a bottom cap 70 formed of a disk having a clamp mechanism 72 extending upwardly therefrom. The clamp mechanism is adapted to allow the bottom cap to releasably engage the lower lip of the intermediate cylinder thus precluding access therein.

As shown in FIG. 9, a chuck 74 is included with a cylindrical configuration. The chuck is situated within the tube and, as such, is adapted to slide vertically therein. During the utilization of the present embodiment, the writing utensil abuts the chuck when situated within the holder tube.

Finally, an actuator disk 76 is situated within the intermediate cylinder having a top face, a bottom face, and a threaded outer periphery 78. The actuator disk suitably has a thickness which is less than ⅛ the length of the holding device. The threaded outer periphery is adapted for threadedly engaging the threaded inner surface of the intermediate cylinder. It should be noted that the actuator disk has an aperture 80 centrally formed therein for encompassing the holder tube. The actuator disk further has a plurality of inwardly extending connectors. Such connectors are integrally coupled between an inner periphery of the aperture of the disk and the chuck. To allow such, the connectors extend through the slits of the holder tube. By this structure, rotation of the actuator disk is effected upon the rotation of the top cap and holder tube.

In use, upon the rotation of the top cap and holder tube with respect to the intermediate cylinder, the threaded engagement between the actuator disk and the intermediate cylinder effects the vertical maneuvering of the chuck and the writing utensil thus allowing the selective dispensing thereof. It should be noted that the chuck extends a distance above the actuator disk approximately equal to the height of the top cap for allowing the chuck to be inserted within the aperture thereof and, therefore allowing the dispensing of the full writing utensil.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved wax pencil holding device comprising, in combination:

an intermediate hollow cylinder with an open bottom end, an open top end, and a closed periphery formed therebetween, the intermediate cylinder having a lower annular lip formed on the bottom end thereof and further extending outwardly therefrom and an upper annular lip formed adjacent the top end thereof and further extending inwardly therefrom, wherein an inner surface of the entire closed periphery is threaded;

a top cap with a generally frusto-conical configuration having an aperture centrally formed therein, a hooked tab mechanism depending from a lower surface thereof for releasably engaging the upper lip of the intermediate cylinder thus allowing the top cap to be rotated with respect to the intermediate cylinder, and a bushing situated about an inner periphery of the aperture thereof and extending slightly inwardly thereby reducing a diameter of the aperture;

an interior writing utensil holder tube coaxially situated within the intermediate cylinder and maintained in such orientation via an integral coupling with the bottom surface of the top cap such that a top end of the tube communicates with the aperture of the top cap and the tube rotates coincidentally with the rotation of the top cap, the tube having a plurality of slits longitudinally formed therein along an entire length thereof, whereby a writing utensil may be situated within the tube and extended from the aperture of the top cap;

a bottom cap formed of a disk having a clamp mechanism extending upwardly therefrom for releasably engaging the lower lip of the intermediate cylinder thus precluding access therein;

a chuck with a cylindrical configuration situated within the tube and adapted to slide vertically therein, whereby the writing utensil abuts the chuck when situated within the holder tube; and an actuator disk situated within the intermediate cylinder having a top face, a bottom face, and a threaded outer periphery for threadedly engaging the threaded inner surface of the intermediate cylinder, the actuator disk having an aperture centrally formed therein for encompassing the holder tube, the actuator disk further having a plurality of inwardly extending connectors integrally coupled between an inner periphery of the aperture thereof and the chuck, with the connectors extending through the slits of the holder tube, thereby effecting rotation of the actuator disk upon the rotation of the top cap and holder tube; whereby upon the rotation of the top cap and holder tube with respect to the intermediate cylinder, the threaded engagement between the actuator disk and the intermediate cylinder effects the vertical maneuvering of the chuck and the writing utensil thus allowing the selective dispensing thereof.

* * * * *